US007991492B1

(12) United States Patent
Namanny et al.

(10) Patent No.: US 7,991,492 B1
(45) Date of Patent: Aug. 2, 2011

(54) NATIONAL REMOTE CONTROLLED STOCK CAR RACING ASSOCIATION

(76) Inventors: Kerry T. Namanny, Atlantic, IA (US); Kenneth D. Namanny, Atlantic, IA (US)

( * ) Notice: Subject to any disclaimer, the term of this patent is extended or adjusted under 35 U.S.C. 154(b) by 1129 days.

(21) Appl. No.: 11/786,695

(22) Filed: Apr. 12, 2007

Related U.S. Application Data

(60) Provisional application No. 60/847,080, filed on Sep. 26, 2006.

(51) Int. Cl.
*G06F 19/00* (2006.01)

(52) U.S. Cl. ..... 700/91; 700/92; 463/6; 463/16; 463/20; 463/42

(58) Field of Classification Search ..... 700/91, 700/92; 463/6, 16, 20, 42
See application file for complete search history.

(56) References Cited

U.S. PATENT DOCUMENTS

| | | | | |
|---|---|---|---|---|
| 4,781,377 | A | 11/1988 | McVean et al. | 463/58 |
| 4,953,873 | A | 9/1990 | Jacobson | 273/274 |
| 5,092,605 | A | 3/1992 | Hoffman | 273/246 |
| 5,372,366 | A | 12/1994 | Gohlke | 273/274 |
| 5,439,228 | A | 8/1995 | Pedersen | 273/236 |
| 5,603,502 | A | 2/1997 | Nakagawa | 273/292 |
| 5,718,429 | A | 2/1998 | Keller, Jr. | 273/274 |
| 5,795,226 | A * | 8/1998 | Yi | 463/22 |
| 5,800,263 | A | 9/1998 | Hayashida et al. | 436/6 |
| 6,020,851 | A * | 2/2000 | Busack | 342/457 |
| 6,254,478 | B1 | 7/2001 | Namanny et al. | 463/6 |
| 6,439,956 | B1 * | 8/2002 | Ho | 446/454 |
| 6,604,996 | B1 | 8/2003 | Namanny et al. | 463/6 |
| 6,726,567 | B1 * | 4/2004 | Khosla | 463/42 |
| 7,402,106 | B2 * | 7/2008 | Weisel et al. | 463/63 |

* cited by examiner

*Primary Examiner* — Pierre Eddy Elisca
*Assistant Examiner* — Shahid Kamal
(74) *Attorney, Agent, or Firm* — James D. Welch

(57) ABSTRACT

A method of conducting a competition with remote controlled vehicles involving young, or young-at-heart people from a plurality of local institutions or establishments, and involving a hierarchy of competitions.

14 Claims, 3 Drawing Sheets

NATIONAL REMOTE CONTROLLED STOCK CAR RACING ASSOCIATION

This Application Claims Benefit of Provisional Application Ser. No. 60/847,080 Filed Sep. 26, 2006.

TECHNICAL FIELD

The present invention relates to racing of remote controlled vehicles and more particularly to a method of conducting competitions therewith at a hierarchy of levels, including determination of winners at each level.

BACKGROUND

Patents to Namanny et al., U.S. Pat. Nos. 6,254,478 and 6,604,996 show that it is known to provide slotless-micro-race-track systems and remote control motorized racing vehicles thereon for the purpose of conducting a competition in which each, (typically a plurality), of the contestants are provided controls for remotely controlling one of such motorized racing vehicles. The competition per se. involves allowing each contestant to remotely control his or her assigned motorized racing vehicle so that it proceeds around the slotless-micro-race-track. Typically a winner of the competition is identified as the contestant who's motorized racing vehicle completes some selected number of laps in a manner judged comparatively superior amongst the contestants, (eg. the fastest), although points might be awarded for instance, on laps a contestant leads and finish position.

It is noted that functional slotless-micro-race-track systems and remote control motorized racing vehicles appropriate for use in practice of the present invention method, are available from Micro-Reality Motorsports of 1500 S.W 7th St., Atlantic, Iowa 50022. However, it is to be understood that a "track" can comprise any functional system, such as cones set out on a floor, or a carpet of appropriate shape, and that participants can build their own car, such as from kits, or purchase a vehicle pre-assembled. Cars will typically be Micro-Reality 1/10 the scale, but can be any functional size or scale.

Continuing, it is further noted that young people at, for instance, high schools, universities, 4-H, FFA, Boy Scouts, TSA, YMCA, YWCA, Church Groups and other clubs or the like, are in need of extra-curricular activities and that businessmen are always looking for ways to make the best use of marketing dollars to the end that customers are drawn to their facilities. Thus is identified a potential need for a method of conducting a competition.

With the foregoing insight, the present invention is disclosed as a method of doing business involving a method for conducting a possibly sponsored competition involving a slotless-micro-race-track system and remote control motorized racing vehicles, which, as a side benefit, might lead to beneficial marketing exposure of said sponsor to a relevant public, which might include a television audience.

Known Patents include U.S. Pat. No. 4,781,377 to McVean et al. Said Patent describes a method of conducting a racing event, and a hybrid sporting event and game show based on the sporting event. The sporting event involves mounting robotic jockeys onto live hackney ponies in a racing event made up of one or more races. The robotic jockeys are remote controlled, and players are provided race cards that contain pairings of a race horse identification and an indicium identifying the animal in a corresponding race. Players can win individual races or an entire event depending on the outcome of races and the content of the race cards held, and other factors. Race cards can be distributed in advance of a race event at the race event location, or at a remote location such as supermarkets. The event, said 377 Patent describes, can be broadcast live and winners can be present at a race event or in the broadcast audience.

Another Patent, U.S. Pat. No. 5,32,293 to Goyette, describes a board game with focus on an auto racing game apparatus and method of play. While said 293 Patent identifies the concept of auto racing, it does not suggest application of a slotless race track and remote control motorized racing vehicles. Another such board game having as its focus a method of playing a racing game, is described in U.S. Pat. No. 5,092,605 to Hoffman.

Additional Patents which describe systems and/or methods of playing a game are disclosed because the inventors are aware of them:

U.S. Pat. No. 5,603,502 to Nakagawa;
U.S. Pat. No. 5,800,263 to Hayashida et al.;
U.S. Pat. No. 5,718,429 to Keller Jr.;
U.S. Pat. No. 4,953,873 to Jacobsen;
U.S. Pat. No. 5,795,226 to Yi;
U.S. Pat. No. 5,372,366 to Gohlke; and
U.S. Pat. No. 5,439,228 to Pedersen.

Even in view of the identified known prior art there remains need for a method of conducting a competition utilizing a slotless-race-track system and remote control motorized racing vehicles.

Need remains for a system and method of introducing people, typically young people but older people can be involved as well, to the practice of racing remote controlled vehicles in locally to nationally recognized and monitored competition settings.

DISCLOSURE OF THE INVENTION

The present invention, in a basic sense, is a method of conducting a competition comprising, in a functional sequence, the steps of:

practicing steps a, b and c in any order or simultaneously, said steps a, b and c being:

a) approaching a local institution which is attended by young people, and negotiating an arrangement therewith requiring said local institution:

provide a track or functional equivalent thereat or making access thereto otherwise available, said track or functional equivalent being suitable for the racing of remote controlled vehicles thereupon;

provide means for transmitting data; and a club or the like be formed thereat that at least two young people in attendance thereat join;

b) requiring at least two young people at said local institution to each procure at least one remote controlled vehicle;

c) providing a central location comprising means for receiving and storing data in machine readable media;

d) at said local institution organizing at least one event comprising having at least two young people thereat operate said remotely controlled vehicles in a race competition on said track or functional equivalent provided or otherwise made available thereat;

e) determining winners of said races and via said means for transmitting data sending data identifying said winner to said central location and storing said data in said central location means for storing data in machine readable media;

f) analyzing data stored at said central location to determine a winner's order amongst said young people who compete, and optionally displaying at least some data and/or analysis results electronically or otherwise.

In a more general sense the present invention is a method of conducting a competition comprising a promoter approaching a plurality of local institutions, each of which are attended by young people, and negotiating arrangements with said institutions requiring:

that at least one thereof provide a track or functional equivalent or otherwise making access thereto available, which track or functional equivalent is suitable for the racing of remote controlled cars thereupon;

provide means for transmitting data; and that a club be formed at each thereof with at least two young people in attendance thereat joining.

(It is noted that two small or more small local institutions can use share a single track, and that at least one smaller institution might "piggy-back" with a larger institution. The later might happen where, for instance, small towns that have schools with only a few students couple-up with a nearby larger local institution and use a track provided thereat along with students from the larger local institution).

The method also requires that young people at each local institution procure, (eg. via a young person using his or her own funds or funds provided by an institution or sponsor), at least one remote controlled vehicle; and the providing of a central location comprising means for receiving and storing data in machine readable media. Note, it is also within the scope of the present invention for a sponsor to provide car(s) and/or to provide funds for procuring a track to an institution.

It is noted at this point, and applies to any embodiment of the invention methodology, that when a vehicle is procured by a young person he or she can be required to register it, and/or a serial number and/or number(s) and/or letter(s) which identify a vehicle at a central location, typically via the internet or other communication network.

Typically at least at two local institutions will be involved and the method requires organizing at least one event comprising having at least two young people at each thereof remotely operate said remotely controlled vehicles in a race on said track or functional equivalent, and determining a winner of said race, then via said means for transmitting data sending data identifying said winner to said central location and storing said data in said central location means for storing data in machine readable media, which can be accessible via a website.

Another recital of a method of conducting a competition comprises, in a functional sequence, the steps of:

practicing steps a, b and c in any order or simultaneously, said steps a, b and c being:

a) approaching at least one local establishment which is attended by young or young at heart people, and negotiating an arrangement therewith requiring said local establishment to:

provide or allow a track or functional equivalent thereat or making access thereto otherwise available, said track or functional equivalent being suitable for the racing of remote controlled vehicles thereupon;

provide means for transmitting data; and said establishment providing that at least two young or young at heart people in attendance thereat participate;

b) requiring at least two young or young at heart people at said local establishment to each procure at least one remote controlled vehicle;

c) providing a location comprising means for receiving and storing data in machine readable media;

d) at said local establishment organizing at least one event comprising having at least two young or young at heart people thereat operate said remotely controlled vehicles in a race competition on said track or functional equivalent provided or otherwise made available thereat;

e) determining at least one winner of a race and via said means for transmitting data sending data identifying said winner to said central location and storing said data in said central location means for storing data in machine readable media;

f) optionally displaying at least some data stored in machine readable media results electronically or otherwise.

Said recital is applicable to practice by the young-at-heart who might meet, for instance, at a bar. The bar would then constitute a "local institution" and events held there would correspond to local events. A national event could then be held in, for instance, Las Vegas.

The method also includes analyzing data stored at said central location to determine a winner's order amongst said young people from a plurality of local institutions, and therefrom selecting the top winners, followed by sponsoring district and/or regional and/or state and/or national competitions therebetween. This is followed by determining a winner of each of said additional race competitions and via said means for transmitting data sending data identifying said winner to said central location and storing said data in said central location means for storing data in machine readable media. Winner's can be determined based on a score based on number of laps lead and/or number of races won. For instance, one point might be awarded for leading a lap in a race, and multiple additional points awarded for last lap position, (eg. winner or other position).

Said method can further comprises at least one of said local institutions obtaining a sponsor to offset the cost of providing the track or functional equivalent, or otherwise making access thereto available.

The local institutions can be high schools, colleges/universities, 4-H, FFA, Boy Scouts, TSA, Cub or Boy Scout, TSA, YMCA, YWCA, Church Groups, Hobby Shops, Clubs attended by adults or the like, and the people attendees thereof.

The method can, but doesn't require, that at least one young person obtaining support by selling advertising on said at least one procured remotely controlled vehicle. It is noted that the terminology "remotely controlled vehicle" can identify any shape of vehicle—car, truck or even fanciful shape such as a boot. The method provides that the at least one young person can keep the support received.

It is further noted that while the target participants are young people, they can be accompanied by older people.

In more general terms, the present invention is a method of conducting a competition which, in preferred practice, involves a sequence of "qualifying" rounds leading-up to a "championship" round. Institutions will provide contestants access to a slotless-micro-racing-track system and allow said contestants to participate in one or more racing events. Contestants participate by providing and remotely controlling motorized racing vehicles on the slotless-micro-racing-track system. (Note, the remotely controlling motorized racing vehicles can be paid for by sponsors and be within the language "contestants participate by providing . . . "). Winners of preliminary round events then proceed to additional rounds of competition, (eg. district, regional, state and national), involving other preliminary round event winners. Contestants hope to win their way through some number of such preliminary round events and thereby earn the right to participate in a "championship" round.

In one embodiment then, the present invention is a method of conducting a competition by a local institution which comprises, as a first step, the providing of a slotless-micro-racing-track system. A preferred slotless-micro-racing-track system, it is noted, is available from Micro-Reality Motorsports of 1500 S.W. 7th St., Atlantic, Iowa 50022, and has a plurality of functionally interconnectable track sections thereby enabling configuration into a variety of continuous shapes. Said shapes can be selected from the group consisting of: (round, oval, tri-oval, "D" shaped, square, rectangular and possibly even an "8" shape), for instance. Further, slotless-micro-racing-track systems can involve tracks of various widths. Said slotless micro-racing-track system further comprises a plurality of remote control racing vehicles, each including a remote control unit for each of said placed remote control motorized racing vehicles. A next step involves providing such slotless micro-racing-track systems at a plurality of locations, such as at high schools, universities, 4-H, Boy Scouts, FFA, TSA clubs etc., and configuring said tracks into desired shape by functionally interconnecting sections thereof. This is followed by placing at least one remote control motorized racing vehicle(s) thereon, and placing a remote control unit for each of said placed remote control racing vehicles near-thereby. Young people will each obtain a racing vehicle, and the competition will typically involve having a plurality of young people simultaneously race on said track. The competition further involves selecting some criteria as how to determine a winner in said racing event, and conducting said event to the end that a winner is identified. Note, it is possible that a competition can involve time trial events where each young person races his or her vehicle individually against time, perhaps to determine pole and running positions. It is noted that young people are encouraged to obtain a sponsor and sell advertising space on his or her racing vehicle thereto, but are not required to do so.

A preferred racing season might be from January to March each year. During the racing season there might be nine local race events at each local institution, each of which might involve six vehicles on a standard track. District races, each involving three local institutions and including eighteen vehicles on a track comprised of three standard tracks can be practiced. Regional events might be practiced with tracks being appropriate to allow twenty-five to thirty-five contestants, and a State race will typically be practiced on a track constructed to allow forty-three contestants. A national championship race would involve fifty contestants, one from each state, participating on a track designed therefore. It is possible that contestants from Territories could be included.

Another recital of a method of conducting a competition comprises, in a functional sequence, the steps of:

practicing steps a, b and c in any order or simultaneously, said steps a, b and c being:

a) approaching at least one local establishment which is attended by young or young at heart people, and negotiating an arrangement therewith requiring said local establishment to:

provide or allow a track or functional equivalent thereat or making access thereto otherwise available, said track or functional equivalent being suitable for the racing of remote controlled vehicles thereupon;

provide means for transmitting data; and said establishment providing that at least two young or young at heart people in attendance thereat participate;

b) requiring at least two young or young at heart people at said local establishment to each procure at least one remote controlled vehicle;

c) providing a location comprising means for receiving and storing data in machine readable media;

d) at said local establishment organizing at least one event comprising having at least two young or young at heart people thereat operate said remotely controlled vehicles in a race competition on said track or functional equivalent provided or otherwise made available thereat;

e) determining at least one winner of a race and via said means for transmitting data sending data identifying said winner to said central location and storing said data in said central location means for storing data in machine readable media;

f) optionally displaying at least some data stored in machine readable media results electronically or otherwise.

Said recital is applicable to practice by the young-at-heart who might meet, for instance, at a bar or other location attended by adults. The bar would then constitute a "local institution" and events held there would correspond to local events. A national event could then be held in, for instance, Las Vegas.

It is noted that the racing vehicles can be shaped as at least one selection from the group consisting of:

car;
truck;
tractor;
sport utility vehicle
snowmobile;
go kart;
quadrunner; and
motorcycle;

as well as possibly unusual shapes such as a shoe, as perhaps requested by a sponsor.

It is also within the scope of the present invention to, at any level of competition, charge spectators to attend or otherwise watch, and/or televise or webcast the proceedings and award prizes Finally, it is forseen that the present invention might also provide a vehicle to students in a formal class which allows them to gain hands-on real world experience in topics such as marketing and sales. For instance, a high school class in business might have students therein actually approach and sell track or vehicle sponsorships to local businessmen.

The present invention will be better understood by reference to the Detailed Description Section of this Specification, in conjunction with the Drawings.

DETAILED DESCRIPTION

Figure 1:
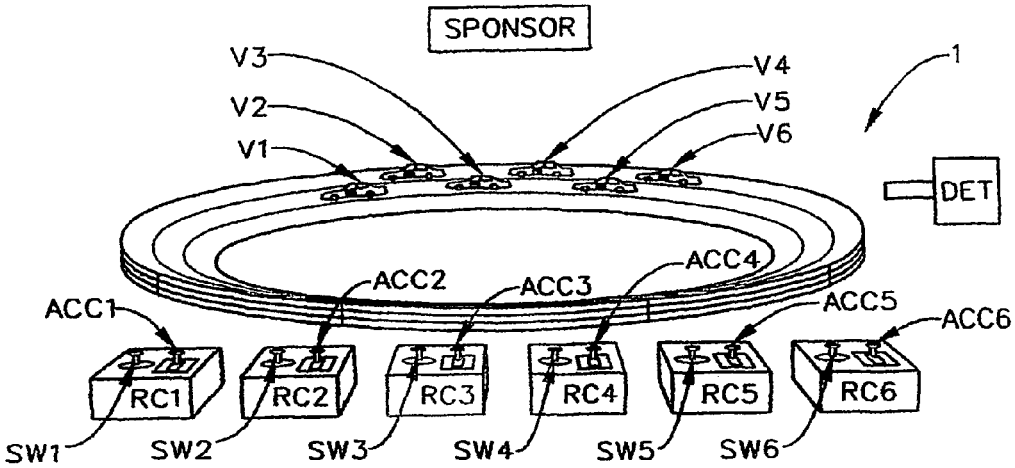
FIG. 1 from Patents to Namanny et al., U.S. Pat. Nos. 6,254,478 and 6,604,996 is included to show a suitable system for use in practicing the method.
Figure 5:
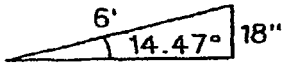
FIG. 5 demonstrates that in side view a slotless-micro-racing-track system section is preferably banked at, a demonstrative and not limiting, approximate fourteen-and-one-half (14.5) degrees.
Figure 6:
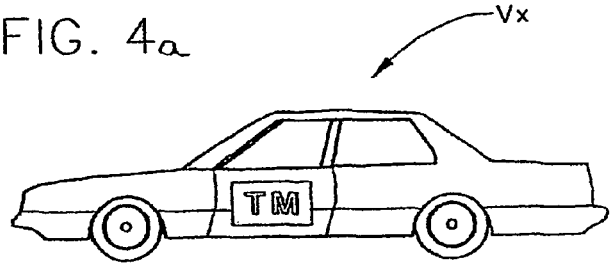
FIG. 6 demonstrate the presence of an identifier (TM) on a motorized racing vehicle, which can be a trademark, serial number, vehicle identifier etc.

Turning now to the drawings, in FIG. 1 there is shown a demonstrative, preferred oval shaped slotless-micro-racing-track system (1) as is available from Micro-Reality Motorsports of 1500 S.W. 7th St., Atlantic, Iowa 50022. FIG. 5 shows that a preferred racing surface of the slotless-micro-racing-track system (1) is banked at an angle of approximately fourteen and one-half (14.5) degrees, with there being an eighteen (18) inch rise over the six foot wide racing surface. Said embankment encourages good motorized racing vehicle traction on the racing surface. It is also to be noted that there is shown a demonstrative sign which can carry the name or trademark or logo etc. of a competition sponsor. As well, contestants can wear clothing with a sponsor's name or trademark or logo etc. of a competition sponsor during a competition. FIG. 6 is included to demonstrate the presence of a sponsor trademark (TM) or other identifying material, such as a car serial number, or vehicle identifying number(s) and/or letters on a motorized racing vehicle (VX). A sponsor of racing competitions can gain exposure and benefit from such presence of its identifying marks at a racing competition, particularly where it is televised.

Figure 2:
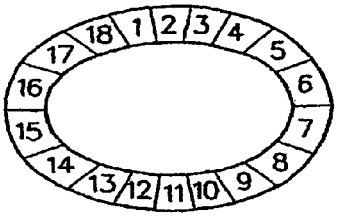
FIGS. 2 and 3 demonstrate oval and circular shaped slotless-micro-racing-track systems constructed from a plurality of functionally interconnectable track sections.
Figure 3:
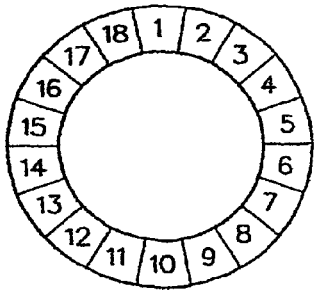
Figure 4A:
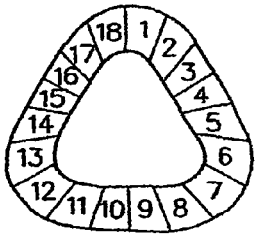
FIG. 4*a*, shows that an alternative track configuration can be essentially triangular shaped.

FIG. 2 demonstrates that said preferred oval shaped slotless-micro-racing-track system is constructed from a plurality of functionally interconnectable track sections. Note FIG. 2 could delete straight sections ((2) and (11)). FIG. 3 shows a circular shaped slotless-micro-racing-track system.

Figure 4B:
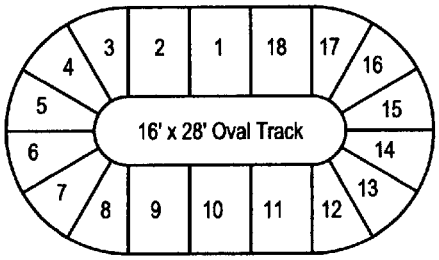
FIGS. 4*b*, 4*c*, 4*d*, 4*e*, 4*f* and 4*g* further show functional track configurations.
Figure 4C:
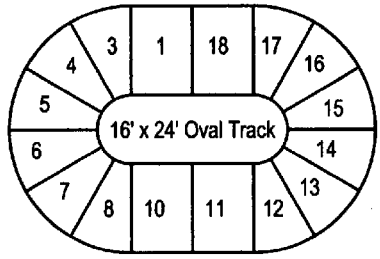
Figure 4D:
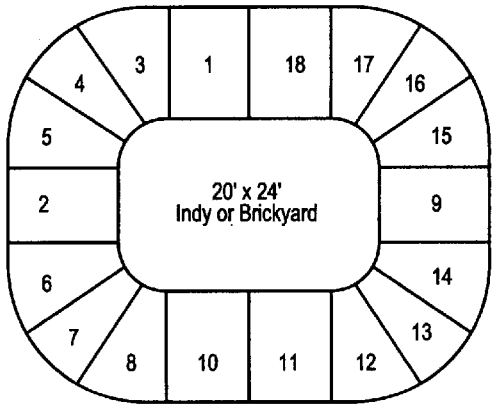
Figure 4E:
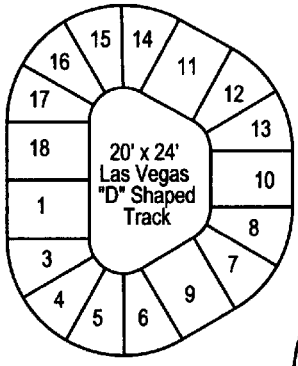
Figure 4F:
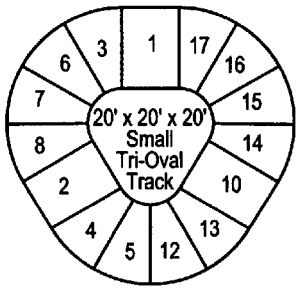
Figure 4G:
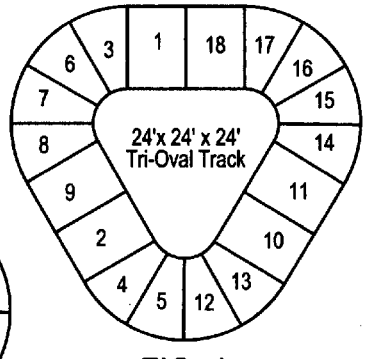

FIGS. 4*a*, 4*b*, 4*c*, 4*d*, 4*e*, 4*f* and 4*g* further show functional configurations. FIGS. 4*b* and 4*c* show an two oval shaped tracks with different elongated distances between the curved ends. FIG. 4*d* shows a somewhat rectangular shaped track, (eg. Indy or Brickyard shape). FIG. 4*e* shows a "D" shape, (eg. Las Vagas shape). FIGS. 4*f* and 4*g* show Triangular shaped tracks. It is emphasised that any functional shape can be used at any level, and the FIGS. 2-4*g* show demonstrative typical shapes for use a the Local level. It is noted that at the District level three of the 16×28 oval trackes can be combined to form a further elongated shape, and at the Regional and State levels a 45×90×12 foot track can be configured, including "Pit" lanes.

Continuing, FIG. 1 also shows the presence to motorized racing vehicles (V1), (V2), (V3), (V4), (V5) and (V6) on the racing surface of the preferred oval shaped slotless-micro-racing-track system, as well as the presence of associated Remote Control Systems (RC1), (RC2), (RC3), (RC4), (RC5) and (RC6). (Note, it is also within the scope of the present invention for contestants to use hand held controlers). It is to be noted that each of the Remote Control Systems as associated therewith a Steering Wheel and Accelerator as follows:

| | | | | | | |
|---|---|---|---|---|---|---|
| REMOTE---CONTROL SYSTEM | (RC1) | (RC2) | (RC3) | (RC4) | (RC5) | (RC6) |
| STEERING---WHEEL | (SW1) | (SW2) | (SW3) | (SW4) | (SW5) | (SW6) |
| ACCEL-ERATOR | (ACC1) | (ACC2) | (ACC3) | (ACC4) | (ACC5) | (ACC6) |

In use, a contestant is provided control over a Racing Vehicle ((V1), (V2), (V3), (V4), (V5), (V6)), associated Remote Control System, (eg. (RC1), (RC2), (RC3), (RC4), (RC5), (RC6)), and operates the associated Steering Wheel ((SW1), (SW2), (SW3), (SW4), (SW5), (SW6)) and Accelerator ((ACC1), (ACC2), (ACC3), (ACC4), (ACC5), (ACC6)), during a competition. Turning Steering Wheel in one direction causes a motorized racing vehicle to turn in one direction, (and vice-versa), and operating an accelerator causes an associated Racing Vehicle to change speed. At the State or higher level it is conceived that the remote control system be of an advanced design such that three ranges of speed, and reverse, be possible. For instance, at the Regional and State levels where the track is configured to include "Pit" lanes, various speed ranges and reverse capability would be of benefit.

It is noted that an acellerator can be controlled by hand or foot and shifters that allow attaining different ranges of speeds can be included and operate automatically or manually. Further simulators can be applied to automate the operation.

For additional insight it is also noted that the motorized racing vehicles utilized in the preferred slotless-micro-racing-track system (1) are approximately twelve (12) to nineteen (19) inches long and five (5) to nine (9) inches wide, and are preferably covered with a removable/replaceable plastic protective covering that serves to prevent damage to the motorized racing vehicles in collisions. In addition this allows easily changing trademark etc. materials visible on said motorized racing vehicles. FIG. 6 is included to demonstrate the presence of a sponsor trademark (TM) on a motorized racing vehicle (VX). As mentioned infra in this Disclosure, a sponsor of racing competitions can gain exposure and benefit from such presence of its identifying marks at a racing competition, particularly where it is televised and/or web cast.

It is further noted that each motorized racing vehicle is equipped with a signal emitting circuit which causes, for instance, a lap counter detector (DET) to activate every time it makes a lap of the slotless-micro-racing-track. This enables keeping accurate count of laps completed by each racing vehicle as each motorized racing vehicle is caused to emit a different signal. The signal from a motorized racing vehicle can be otherwise used. It is possible that a lap counter can determine the outcome of a race.

In addition, it is to be understood that a remote control system can include a robotic drive in a racing vehicle, that there can be a camera mounted in a racing vehicle, that prizes can be awarded to contestants in additional steps of a race event competition, that multiple sponsors can sponsor a race event competition, and that race event competitions can be televised and/or webcast, from, for instance, a television station or from a remote location.

It is also noted that the terminology "Sponsor" is to be interpreted broadly to include the provider of a slotless micro racing track system, institutions, businesses, establishments, and/or individuals who make locations for conducting the competition available, one who pays money to have advertising present on a track or on the racing vehicle thereof, (ie. a "Contingency" Sponsor). Further, the terminology "Sponsor" can refer to an "Anchor" Sponsor who underwrites, for instance, expenses beyond the Local level, or the entire series. Support from an Anchor Sponsor can be supplemented by a "Race" Sponsor who covers expenses on a more focused race by race basis.

It is also noted that the terminology "young people" is to be interpreted to include the "young at heart". That is, the terminology "young person" and the like is to be interpreted broadly enough to include practicing the methodology with older people who are associated with various local institutions suited therefore. Such "older people" who would take part are to be considered "young at heart" and are "young people" as that terminology is used in this Specification.

Figure 7:
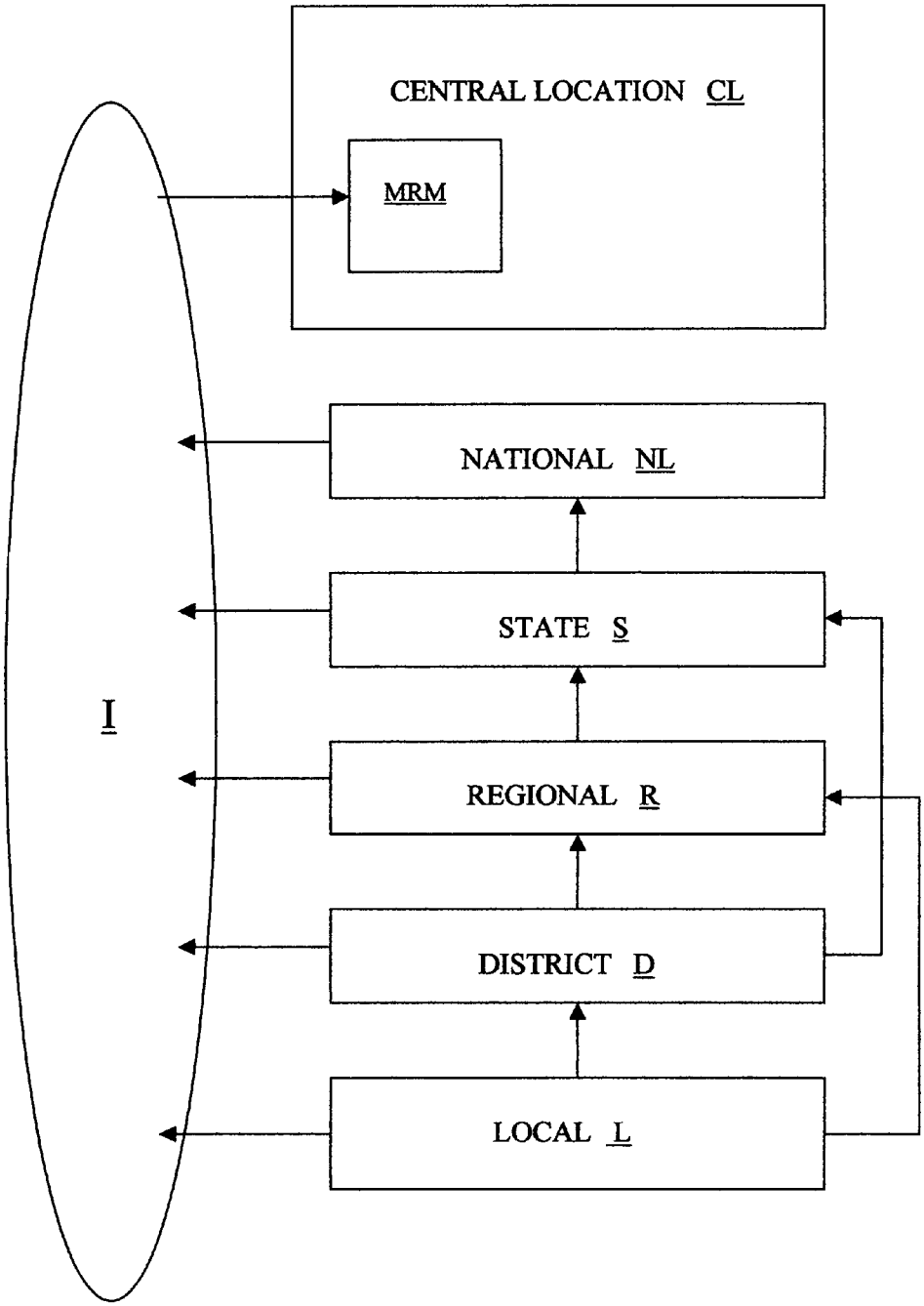
FIG. 7 shows a typical flow diagram of the present invention method.

FIG. 7 shows a typical flow diagram of the present invention method. FIG. 7 shows that a present invention method begins with competition at a Local level, with winner thereat advancing to a District or Regional level. A Local level event might involve young people from a single institution, or might involve young people from two or so institutions. Note that the District or Regional level might be skipped, but when practiced will typically involve, for instance, institutions in a single city. The Regional level involves, for instance, two or more cities. Winners at the Regional level advance to a State level. Winners from each of the States advances to a National competition. Also shown is a Central Location, (can be in any functional location), and indication that information from each of the Local, District Regional, State and National levels is sent thereto and stored in machine readable media, via the Internet (I) or other communication system.

It is further disclosed that the methodology can involve charging those who attend an event as spectators, televising or web-casting events, and allowing access to recorded or live events on a pay-for-view basis.

Also, while the terminology "club", "group", "team", "class" "establishment" all convey the meaning of a group of contestants, the terminology "establishment" is more applicable to a group of the "young-at-heart" who gather at an "establishment", which can be a bar or other adult club. Where said interpretation is applied, the levels of State and National competition can be though of as identifying competitions in, for instance Bars or other location attended by adults, and perhaps a competition in, for instance, Las Vegas, respectively. Further, the terminology "class" can refer to a group of students who are enrolled in a formal class. The present invention might be used as a vehicle to, for instance, teach salesmanship with students being involved in selling sponsorships of vehicles etc.

It is to be understood that the drawings and discussion in this Disclosure show and describe exemplary, not limiting, slotless-micro-racing-track systems, and that any functionally similar slotless-micro-racing-track systems can be utilized in practice of the present invention methodology, which methodology was disclosed in the Disclosure of the Invention Section of this Disclosure.

Having hereby disclosed the subject matter of the present invention, it should be obvious that many modifications, substitutions, and variations of the present invention are possible in view of the teachings. It is therefore to be understood that the invention may be practiced, other than as specifically described, and should be limited in its breadth and scope only by the Claims.

We claim:

1. A method of conducting a competition comprising, in a functional sequence, the steps of:

a) approaching a plurality of local institutions, each of which are attended by young people, and negotiating arrangements with at least two of said local institutions requiring the:

providing of a track or functional equivalent thereat or making access thereto otherwise available, said track or functional equivalent being suitable for the racing of remote controlled vehicles thereupon;

providing a system to transmit data; and providing that at least two young people in attendance thereat participate;

b) requiring at least two young people at each local institution to each procure at least one remote controlled vehicle;

c) providing a central location comprising a system for receiving and storing data in machine readable media, said central location functionally located at a selection from the group consisting of:

at one only of said local institutions; and other than at a local institution;

said steps a, b and c being practiced in any order, or simultaneously;

d) at, at least two local institutions organizing at least one event comprising having at least two young people thereat operate said remotely controlled vehicles in a race competition on said track or functional equivalent provided or otherwise made available at each of the local institutions;

e) determining winners of said races and via said system to transmit data sending data identifying said winner to said central location and storing said data in said central location system to store data in machine readable media;

f) analyzing data stored at said central location to determine a winner's order amongst said young people who compete, and optionally displaying at least some data and/or analysis results electronically or otherwise;

said method further comprising using the determination of the winners via analyzing data stored at said central location in step f, to determine an order amongst said young people from a plurality of local institutions and therefrom selecting the top winners, followed by sponsoring at least one additional competition selected from the group consisting of:

district; regional;

state; and national;

followed by determining a winner of said at least one additional competition; and via said system to transmit data sending data identifying said winner to said central location and storing said data in said central location system to store data in machine readable media.

2. A method as in claim 1 which further comprises at least one of said local institutions obtaining a sponsor to offset the cost of providing the track or functional equivalent suitable for the racing of remote controlled vehicles thereupon provided thereat.

3. A method as in claim 1 wherein the local institutions are high schools, colleges/universities, 4-H, Boy Scout, FFA, TSA, YMCA, YWCA, Church Groups, hobby shops, organizations attended by adults, and the young or young at heart people are members or at least attendees thereof.

4. A method as in claim 1 wherein at least one young person obtains support by selling advertising on said at least one remotely controlled vehicle procured in step b.

5. A method as in claim 1 wherein the winner's order amongst all said young people who compete is determined based on a score based on number of laps lead and/or number of races won.

6. A method as in claim 1, in which said central location system to store data in machine readable data is a website.

7. A method as in claim 1, in which older people accompany the young people.

8. A method as in claim 1 in which the order amongst said young people from a plurality of local institutions prior to said at least one additional competition selected from the group consisting of:

district; regional;

state; and national;

is determined based on a score based on number of laps lead and/or race finish position and/or number of races won.

9. A method as in claim 1 in which there are district and/or regional, and state and national competitions.

10. A method as in claim 1 in which there are state and national competitions.

11. A method as in claim 1 which further comprises providing each winner a certificate or other reward.

12. A method as in claim 10 which further comprises providing each winner a certificate or other reward.

13. A method as in claim 11 which further comprises providing each winner a certificate or other reward.

14. A method as in claim 1 which further comprises televising the proceedings.

* * * * *